US009812050B2

(12) United States Patent
Choi et al.

(10) Patent No.: US 9,812,050 B2
(45) Date of Patent: Nov. 7, 2017

(54) DISPLAY DRIVING DEVICE COMPENSATING FOR OFFSET VOLTAGE AND METHOD THEREOF

(71) Applicants: SK HYNIX INC., Icheon (KR); INDUSTRY-UNIVERSITY COOPERATION FOUNDATION HANYANG UNIVERSITY, Seoul (KR)

(72) Inventors: Byong Deok Choi, Seoul (KR); Don Ku Lee, Seoul (KR)

(73) Assignees: SK HYNIX INC., Icheon (KR); INDUSTRY-UNIVERSITY COOPERATION FOUNDATION HANYANG UNIVERSITY, Seoul (KR)

( * ) Notice: Subject to any disclaimer, the term of this patent is extended or adjusted under 35 U.S.C. 154(b) by 390 days.

(21) Appl. No.: 14/321,708

(22) Filed: Jul. 1, 2014

(65) Prior Publication Data

US 2015/0179125 A1 Jun. 25, 2015

(30) Foreign Application Priority Data

Dec. 24, 2013 (KR) ..... 10-2013-0162492

(51) Int. Cl.
*G09G 3/36* (2006.01)
*G09G 3/20* (2006.01)

(52) U.S. Cl.
CPC ..... *G09G 3/20* (2013.01); *G09G 2310/027* (2013.01); *G09G 2320/0233* (2013.01); *G09G 2320/0285* (2013.01)

(58) Field of Classification Search
None
See application file for complete search history.

(56) References Cited

U.S. PATENT DOCUMENTS

2007/0024541 A1* 2/2007 Ryu ..... G09G 3/3233 345/76
2007/0257897 A1* 11/2007 Tang ..... G09G 3/3614 345/204
2008/0030495 A1* 2/2008 Shirasaki ..... G09G 3/3233 345/214
2008/0036708 A1* 2/2008 Shirasaki ..... G09G 3/3233 345/76
2008/0246785 A1* 10/2008 Shirasaki ..... G09G 3/3233 345/690

(Continued)

FOREIGN PATENT DOCUMENTS

KR 10-2009-0043167 A 5/2009
KR 10-2010-0094183 A 8/2010

(Continued)

*Primary Examiner* — Kent Chang
*Assistant Examiner* — Benjamin Morales Fernande

(57) ABSTRACT

A display driving device includes a data driver having a plurality of output drivers configured to output display driving signals. The display driving device also includes an offset adjusting circuit configured to subtract offset voltages generated in the output drivers from an input image signal to generate a corrected image signal. The offset adjusting circuit transmits the corrected image signal to the data driver, so that the data driver outputs the driving signals based on the corrected image signal.

13 Claims, 5 Drawing Sheets

(56) References Cited

U.S. PATENT DOCUMENTS

| | | | | |
|---|---|---|---|---|
| 2009/0021462 | A1* | 1/2009 | Furihata | G09G 3/2011 345/89 |
| 2009/0207160 | A1* | 8/2009 | Shirasaki | G09G 3/3233 345/212 |
| 2009/0294777 | A1* | 12/2009 | Cheng | C23C 16/0272 257/77 |
| 2010/0026730 | A1* | 2/2010 | Okutani | G09G 3/3648 345/690 |
| 2010/0225634 | A1* | 9/2010 | Levey | G09G 3/3208 345/212 |
| 2011/0157133 | A1* | 6/2011 | Ogura | G09G 3/20 345/211 |

FOREIGN PATENT DOCUMENTS

| | | | |
|---|---|---|---|
| KR | 10-2012-0108383 | A | 10/2012 |
| KR | 10-2012-0111013 | A | 10/2012 |

* cited by examiner

DISPLAY DRIVING DEVICE COMPENSATING FOR OFFSET VOLTAGE AND METHOD THEREOF

CROSS-REFERENCE TO RELATED APPLICATION

The present application claims priority to Korean Patent Application No. 10-2013-0162492, filed on Dec. 24, 2013, which is incorporated by reference herein in its entirety.

BACKGROUND

1. Field

Embodiments of the present disclosure relate to a display device, and more particularly, to a display driving device to compensate for an offset voltage that is included in an output signal for driving a display panel and a method thereof.

2. Description of the Related Art

In modern society, display devices have come into widespread use. In particular, as electronic devices such as portable computers and mobile communication devices become widely used, display devices included in the electronic devices are desirable to become smaller in size and lighter in weight. As a result, various technologies have been developed for such display devices. The widely used display devices include liquid crystal displays (LCDs), plasma display panels (PDPs), organic light-emitting diodes (OLEDs), active-matrix organic light-emitting diodes (AMOLEDs), or the like.

For example, a display device includes a display panel to display image data, a timing controller to process the image data and generate a timing control signal, and a data driver to drive the display panel using the image data and the timing control signal.

The data driver and the display panel may be coupled to each other through a plurality of channels. The data driver outputs a plurality of driving voltage signals, such that the number of the driving voltage signals is equal to the number of channels. The driving voltage signals may include offset voltages that have different levels. These offset voltages may result from various factors of a manufacturing process of the data driver. Different offset voltages may lead to some issues related to the uniformity of an image displayed on the display panel, e.g., reduced sharpness of the image.

SUMMARY

Various embodiments of the present disclosure are directed to a display driving device for compensating for an offset voltage that is included in a signal for driving a display panel.

In an embodiment, a display driving device for driving a display panel includes a data driver having a plurality of output drivers, each being configured to output driving signals for driving the display panel and an offset adjusting circuit configured to subtract offset voltages generated in the output drivers from an input image signal to generate a corrected image signal and to transmit the corrected image signal to the data driver so that the data driver outputs the driving signals based on the corrected image signal, the input image signal being input from an external node.

The offset adjusting circuit may include an offset detector coupled to the output drivers and configured to detect the offset voltages of the output drivers and an offset corrector coupled to the offset detector and the data driver and configured to subtract the offset voltages from the input image signal.

In an embodiment, a method includes detecting offset voltages of a plurality of output drivers of a data driver, receiving an input image signal from an external node, subtracting the offset voltages of the output drivers from the input image signal to generate a corrected image signal, transmitting the corrected image signal to the data driver, and outputting data driving signals through the output drivers.

DETAILED DESCRIPTION

Figure 1:
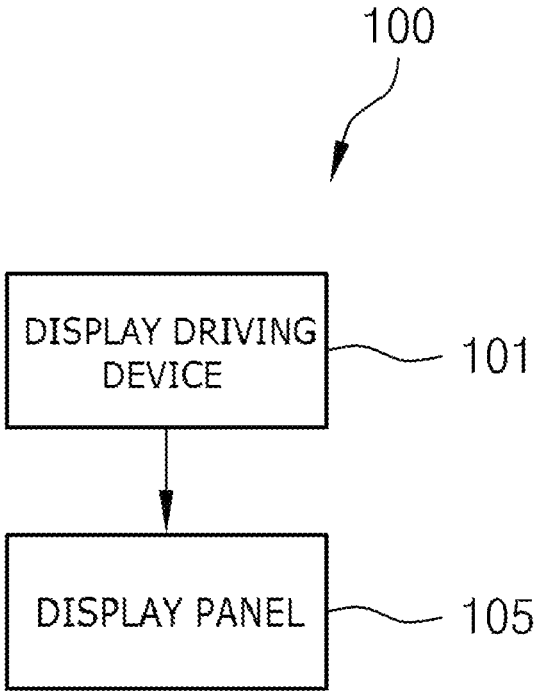
FIG. 1 illustrates a block diagram of a display device in accordance with an embodiment.

Various embodiments will be described below with reference to the accompanying drawings. The present invention may, however, be embodied in different forms and should not be construed as limited to the embodiments set forth herein. Rather, these embodiments are provided so that the present disclosure will be thorough and complete, and will fully convey the scope of the present invention to those skilled in the art. Throughout the present disclosure, like reference numerals refer to like parts throughout the drawings and embodiments of the present disclosure.

In this specification, if a first element sends data or a signal to a second element, the first element may send the data or signal to the second element directly or indirectly (e.g., via at least one intervening element).

FIG. 1 illustrates a block diagram of a display device in accordance with an embodiment. The display device 100 includes a display driving device 101 and a display panel 105.

The display driving device 101 receives an input image signal from an external node and drives the display panel 105 based on the input image signal. In an embodiment, the display driving device 101 generates and outputs a driving signal to control the display panel 105.

The display panel 105 receives the driving signal from the display driving device 101 and displays an image corresponding to the input image signal in response to the driving signal. The display panel 105 may include a liquid crystal display (LCD), a plasma display panel (PDP), an organic light-emitting diode (OLED), an active-matrix organic light-emitting diode (AMOLED), or the like.

Figure 2:
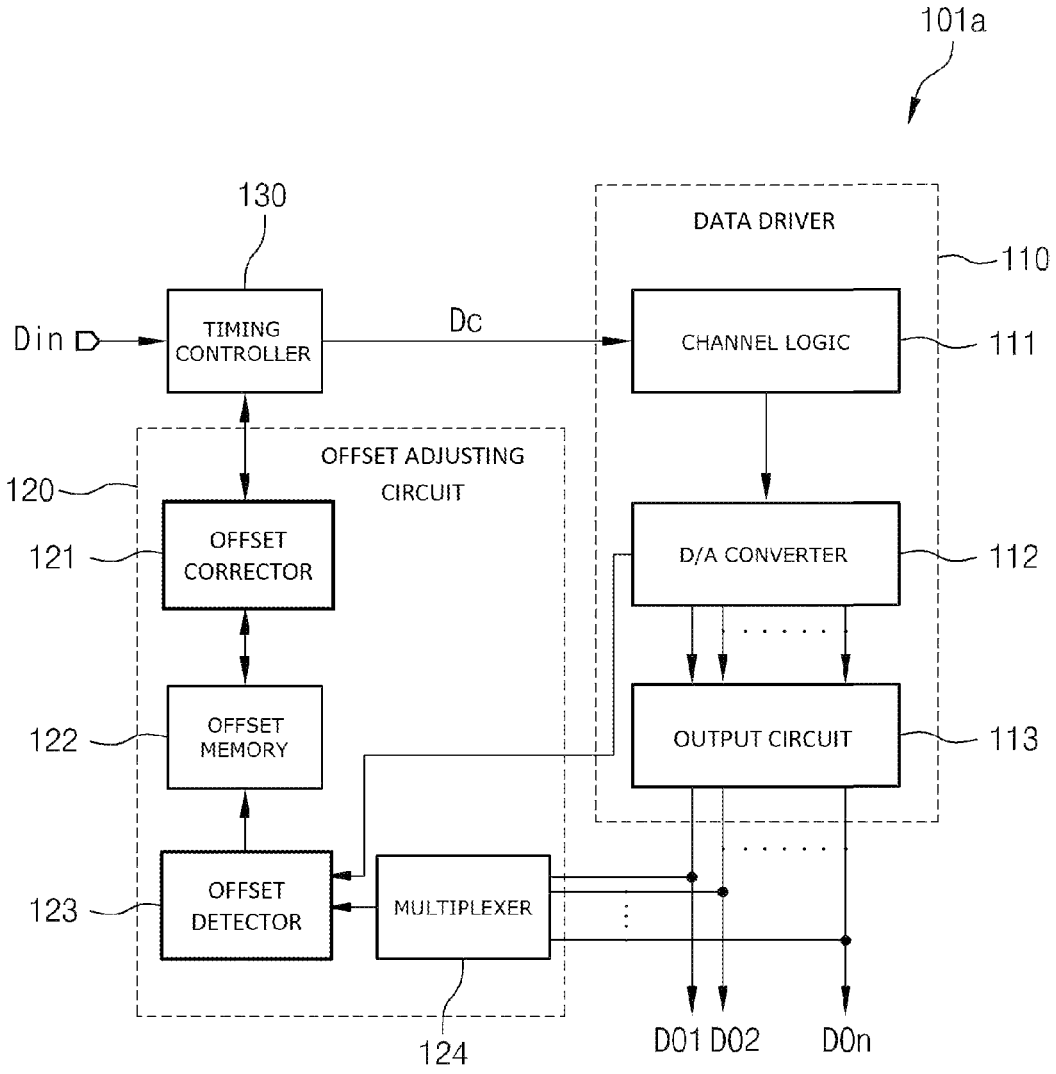
FIG. 2 illustrates a block diagram of a display driving device shown in FIG. 1 in accordance with a first embodiment.

FIG. 2 illustrates a block diagram 101*a* of the display driving device 101 of FIG. 1 in accordance with a first embodiment. The display driving device 101*a* includes a timing controller 130, a data driver 110, and an offset adjusting circuit 120.

The data driver 110 includes a channel logic 111, a digital-to-analog (D/A) converter 112, and an output circuit 113. The offset adjusting circuit 120 includes an offset corrector 121, an offset memory 122, an offset detector 123, and a multiplexer 124.

In a normal operation, the timing controller 130 receives an input image signal Din from an external node and controls the data driver 110. In an offset detection operation to detect offset voltages generated in the data driver 110, the timing controller 130 provides the data driver 110 with an offset detection signal instead of the input image signal Din.

In particular, when the data driver 110 is initially driven before the normal operation is performed, the offset detector 123 of the offset adjusting circuit 120 performs the offset detection operation to detect offset voltages generated in a plurality of output drivers included in the data driver 110. In an embodiment, during the offset detection operation, the timing controller 130 generates the offset detection signal for detecting the offset voltages to the data driver 110. In another embodiment, the offset corrector 121 of the offset adjusting circuit 120 generates the offset detection signal and transmits the offset detection signal to the data driver 110 via the timing controller 130. The offset detection signal transmitted to the data driver 110 is transmitted to the D/A converter 112 via the channel logic 111 and converted into analog signals. The analog signals are input to the output circuit 113 and the offset detector 123. The offset detector 123 detects the offset voltages of the output drivers of the output circuit 113 based on the analog signals and display driving signals D01~D0*n* output from the output circuit 113, which include the offset voltages. The detected offset voltages are stored in the offset memory 122. The offset detection operation will be described in detail later.

When the data driver 110 performs the normal operation after the offset detection operation, the data driver 110 outputs display driving signals D01~D0*n* to control the display panel 105 (see FIG. 1). During the normal operation, the timing controller 130 receives from the offset corrector 121 a corrected image signal Dc, which is obtained by performing offset voltage adjustment, e.g., by subtracting the detected offset voltages from the input image signal Din, and sends the corrected image signal Dc to the data driver 110. The offset voltage adjustment is performed in the offset corrector 121 so as to generate the corrected image signal Dc.

During the offset detection operation, as described above, the data driver 110 receives the offset detection signal and converts the offset detection signal into the analog signals using the D/A converter 112. The analog signals are transmitted to the plurality of output drivers in the output circuit 113 and the offset detector 123.

During the normal operation, the data driver 110 receives the corrected image signal Dc from the timing controller 130.

The corrected image signal Dc is input to the D/A converter 112 via the channel logic 111. The D/A converter 112 converts the corrected image signal Dc into analog signals and outputs the analog signals to the output circuit 113. The output circuit 113 processes the analog signals and outputs the processed analog signals to the display panel 105 of FIG. 1 as the display driving signals D01~D0*n*. The corrected image signal Dc, which has been obtained by subtracting the offset voltages of the output drivers from the input image signal Din as described above. Each of the output drivers in the output circuit 113 outputs a corresponding one of the display driving signals D01~D0*n*, which includes an analog signal corresponding to the corrected image signal Dc and an offset voltage of the corresponding output driver. Since the offset voltage has been subtracted when determining the corrected image signal Dc, the subtraction of the offset voltage may compensate for the offset voltage generated in the corresponding output driver. As a result, because of the offset voltage adjustment performed in the offset corrector 121, the offset voltages generated in the output drivers are compensated and less affect the display driving signals D01~D0*n* compared to when the input image signal Din is directly transmitted to the data driver 110 without the offset voltage adjustment.

In other words, before the data driver 110 normally operates, for example, during the offset detection operation of the data driver 110, the offset adjusting circuit 120 detects the offset voltages generated in the plurality of output drivers of the data driver 110. Thereafter, during the normal operation of the data driver 110, when the data driver 110 outputs the display driving signals D01~D0*n* to drive the display panel 105 of FIG. 1, the offset adjusting circuit 120 subtracts the offset voltages corresponding to the output drivers from the input image signal Din inputted to the timing controller 130. When the plurality of output drivers processes the analog signals corresponding to the corrected image signal Dc, the offset voltages corresponding to the output drivers are added to the analog signals. As a result, although offset voltages are generated in the output drivers, the offset voltages finally included in the display driving signals D01~D0*n* are substantially reduced by the offset voltage adjustment.

As described above, the offset adjusting circuit 120 operates to correct the offset voltages generated in an output stage of the data driver 110, so that the input image signal Din input to the display driving device 101*a* is less affected by the offset voltages. In other words, the display driving signals D01~D0*n* output from the data driver 110 to the display panel 105 (see FIG. 1) is less affected by the offset voltages. As a result, the uniformity of an image displayed on the display panel 105 (see FIG. 1) can be improved so that a sharper image is displayed on the display panel 105.

As described above, the offset adjusting circuit 120 further includes the multiplexer 124. The multiplexer 124 is coupled to a plurality of output terminals of the output circuit 113. The multiplexer 124 receives the display driving signals D01~D0*n* from the output circuit 113 and sequentially sends the display driving signals D01~D0*n* to the offset detector 123. In an embodiment, the multiplexer 124 is activated during the offset detection operation and deactivated during the normal operation. Although not shown in the drawings, the multiplexer 124 may be configured to operate under the control of the timing controller 130 or the offset detector 123.

The offset detector 123 is coupled to the multiplexer 124. During the offset detection operation, the offset detector 123 detects the offset voltages generated in the output drivers of the data driver 110. When the offset detection signal is input to the data driver 110, the D/A converter 112 outputs analog signals corresponding to the offset detection signal, and the output circuit 113 outputs the display driving signals D01~D0*n* based on the analog signals. The offset detector 123 receives the analog signals from the D/A converter 112 and one of the display driving signals D01~D0*n* signals, which has been sequentially selected by the multiplexer 124. The offset detector 123 compares each of the received analog signals with the received display driving signal to detect an offset voltage corresponding to an output driver from which the selected display driving signal has been output. By performing comparisons with respect to the plurality of output drivers of the output circuit 113, the offset detector 123 can detect the offset voltages generated in the output drivers. In an embodiment, the offset detector 123 is not activated during the normal operation of the data driver 110. In this embodiment, the offset detector 123 operates at a time after power is supplied to the display device 100 (see FIG. 1) and before the input image signal Din for the normal operation is input to the timing controller 130. In some embodiments, however, the offset detector 123 may detect the offset voltages during the normal operation of the data driver 110.

The D/A converter 112 of the data driver 110 receives a first digital signal, e.g., the offset detection signal or the corrected images signal Dc, from the channel logic 111 and converts the first digital signal into analog signals. Since the offset detector 123 receives the analog signals and outputs a second digital signal indicative of an offset voltage to be stored in the offset memory 122, the offset detector 123 may include an analog-to-digital (A/D) converter.

The offset memory 122 receives the second digital signal indicative of the offset voltages from the offset detector 123 and stores the offset voltages corresponding to the plurality of output drivers. In an embodiment, the offset memory 122 is an element physically separate from the timing controller 130 and the offset detector 123. In another embodiment, the offset memory 122 is included in the timing controller 130 or the offset detector 123. For example, a memory included in the timing controller 130 or the offset detection unit 123 may serve as the offset memory 122.

The offset corrector 121 is coupled to the timing controller 130 and the offset memory 122. During the normal operation of the data driver 110, the offset corrector 121 reads the offset voltages stored in the offset memory 122, receives the input image signal Din from the timing controller 130, and subtracts the offset voltages from the input image signal Din. Subsequently, the offset corrector 121 sends the subtracted image signal as the corrected image signal Dc to the channel logic 111 via the timing controller 130. That is, values of the corrected image signal Dc generated in the offset corrector 121 are reduced by the offset voltages corresponding to the plurality of output drivers, and then transmitted to the channel logic 111 of the data driver 110 via the timing controller 130. In an embodiment, when the data driver 110 is initially driven, for example, during the offset detection operation, the offset corrector 121 is deactivated.

As a result, the input image signal Din transmitted to the display panel 105 (see FIG. 1) is less affected by the offset voltages generated in the plurality of output drivers of the data driver 110, compared to when the input image signal Din is directly transmitted to the data driver 110 without the offset voltage adjustment. Accordingly, the uniformity of an image displayed on the display panel 105 (see FIG. 1) can be improved, and thus a sharper image is displayed on the display panel 105.

Figure 3:
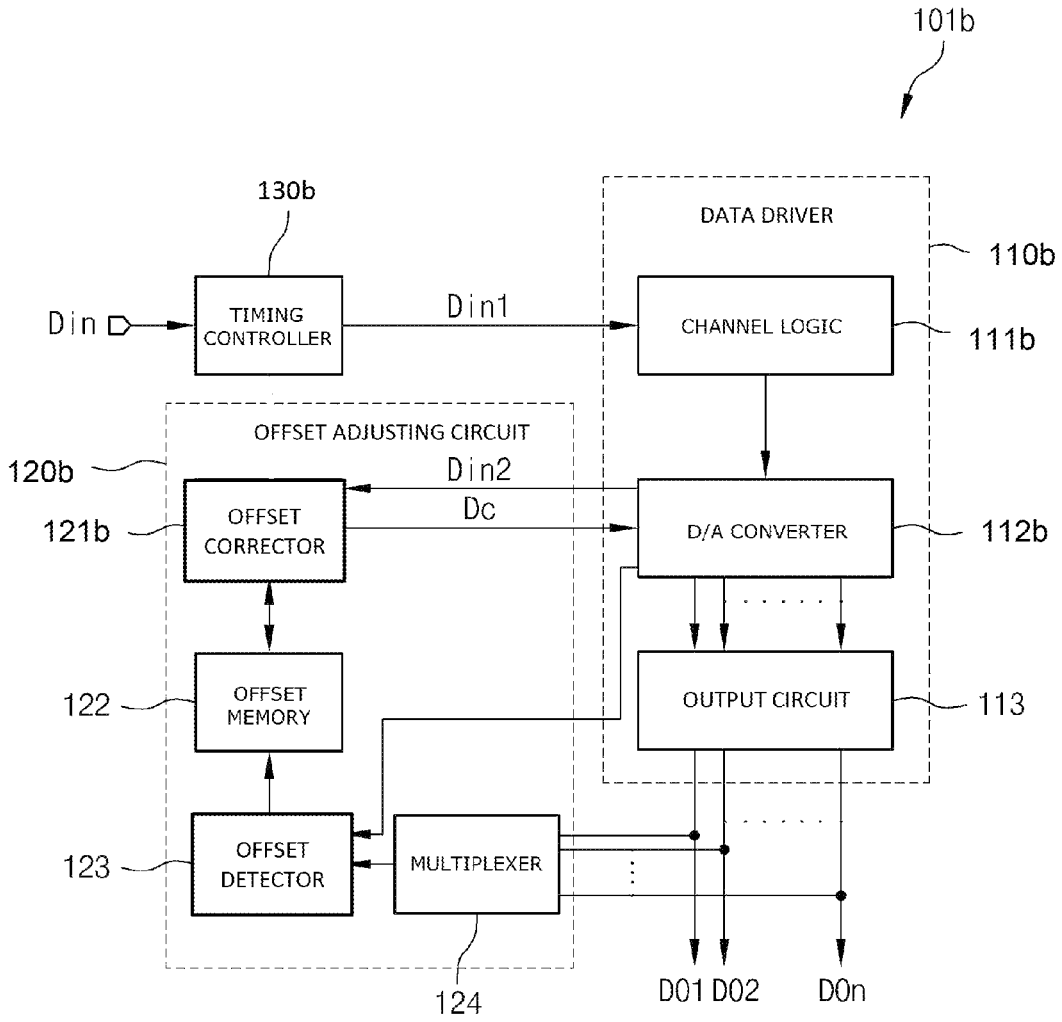
FIG. 3 illustrates a block diagram of a display driving device shown in FIG. 1 in accordance with a second embodiment.

FIG. 3 illustrates a block diagram 101*b* of the display driving device 101 of FIG. 1 in accordance with a second embodiment. The display driving device 101*b* includes a timing controller 130*b*, a data driver 110*b*, and an offset adjusting circuit 120*b*. In an embodiment, when the data driver 110*b* is initially driven (e.g., during an offset detection operation), the timing controller 130*b* generates and sends an offset detection signal instead of an input image signal Din input from an external node to the data driver 110*b* to detect an offset voltage. In another embodiment, the offset detection signal is generated in an offset corrector 121*b* and directly transmitted to the data driver 110*b* since the offset corrector 121*b* is not coupled to the timing controller 130*b* unlike in the configuration illustrated in FIG. 2. Then, the offset detector 123 detects offset voltages generated in a plurality of output drivers of the data driver 110*b* based on the offset detection signal and stores the detected the offset voltages in an offset memory 122, as described above with reference to FIG. 2.

The offset corrector 121*b* is coupled to a D/A converter 112*b* included in the data driver 110*b*. During a normal operation of the data driver 110*b*, the offset corrector 121*b* reads the offset voltages stored in the offset memory 122, receives a second image signal Din2 from the D/A converter 112*b*, and subtracts the offset voltages from the second image signal Din2. Subsequently, the offset corrector 121*b* sends the subtracted image signal as a corrected image signal Dc to the D/A converter 112*b*. Then, analog signals corresponding to the corrected image signal Dc are transmitted from the D/A converter 112*b* to the plurality of output drivers of the output circuit 113. That is, these analog signals correspond to the corrected image signal Dc, which is obtained by subtracting the offset voltages generated in the plurality of the output drivers from the second image signal Din2.

The output circuit 113 processes the analog signals received from the D/A converter 112*b* and outputs the processed signals as display driving signals D01~D0*n*. When an analog signal is processed by an output driver, the output driver outputs a corresponding one of the display driving signals D01~D0*n*, which includes a signal corresponding to the analog signal and an offset voltage of the output driver. Since, however, the offset voltage has been subtracted from the input image signal Din when offset voltage adjustment is performed in the offset corrector 121*b* to generate the corrected image signal Dc, an offset voltage generated in the output driver is compensated and less affects the display driving signal D01~D0*n* compared to when the input image signal Din is directly transmitted to a channel logic 111*b* of the data driver 110*b* as a first image signal Din1 without the offset voltage adjustment. In an embodiment, the second image signal Din2 corresponds to the first image signal Din1 input to the D/A converter 112*b* via the channel logic 111*b*.

As a result, the first image signal Din1 transmitted to the display panel 105 (see FIG. 1) is less affected by the offset voltages generated in the plurality of output drivers of the data driver 110*b*. Accordingly, the uniformity of an image displayed on the display panel 105 can be improved, and thus a sharper image is displayed on the display panel 105.

Figure 4:
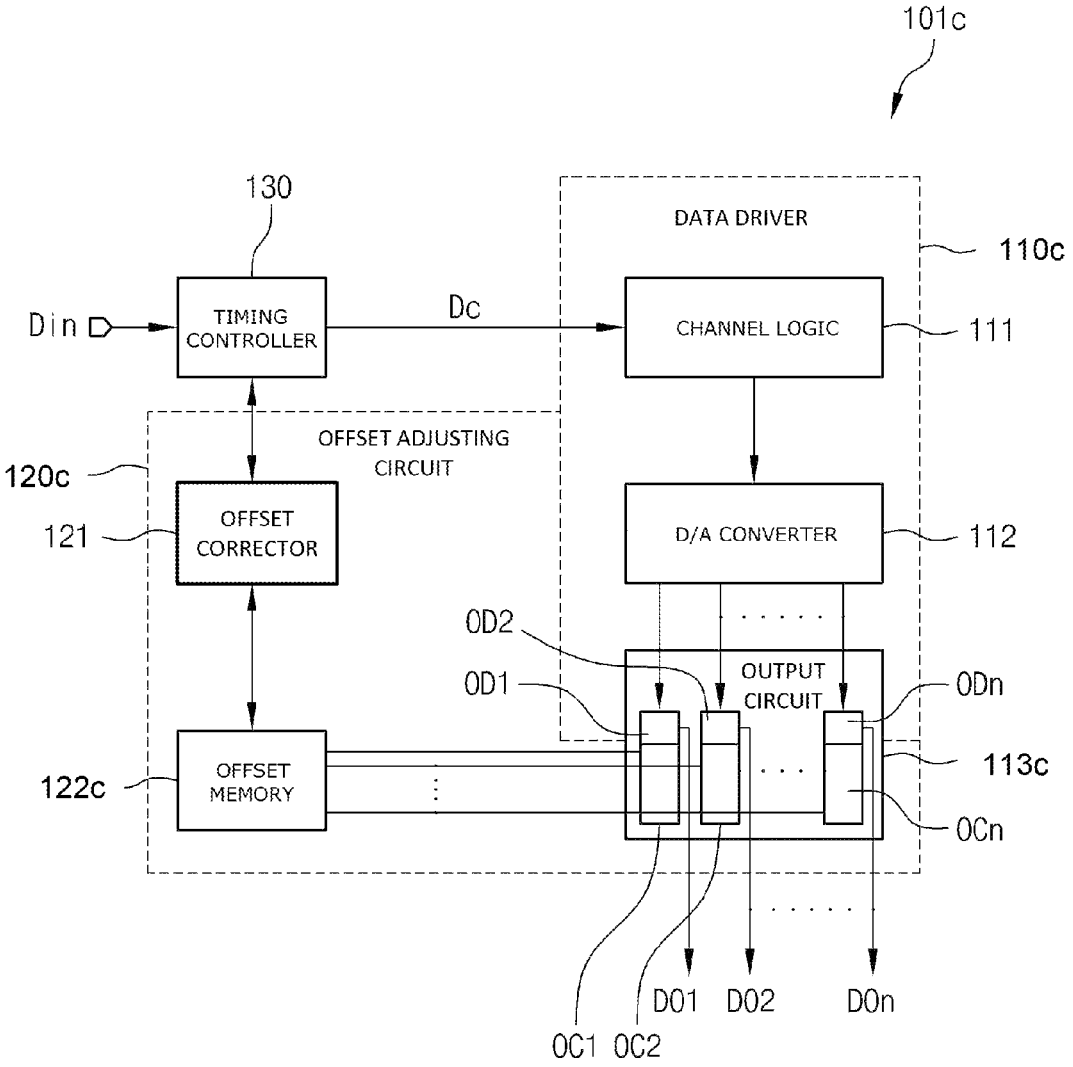
FIG. 4 illustrates a block diagram of a display driving device shown in FIG. 1 in accordance with a third embodiment.

FIG. 4 illustrates a block diagram 101*c* of the display driving device 101 of FIG. 1 in accordance with a third embodiment. The display driving device 101*c* includes a timing controller 130, a data driver 110*c*, and an offset adjusting circuit 120*c*.

The data driver 110*c* includes a channel logic 111, a digital-to-analog (D/A) converter 112, and an output circuit 113*c*. The offset adjusting circuit 120*c* includes an offset corrector 121 and an offset memory 122*c*. Unlike in the configuration of FIG. 2, the data driver 110*c* of FIG. 4 includes a plurality of offset detectors OC1~OCn that is coupled to a plurality of output drivers OD1~ODn in the output circuit 113*c*.

As described with reference to FIG. 2, in a normal operation, the timing controller 130 receives an input image signal Din from an external node and controls the data driver 110*c*. In an offset detection operation to detect offset voltages generated in the data driver 110*c*, the timing controller 130 provides the data driver 110*c* with an offset detection signal instead of the input image signal Din.

In particular, when the data driver 110*c* is initially driven before the normal operation is performed, the offset adjusting circuit 120*c* detects the offset voltages generated in the plurality of output drivers OD1~ODn included in the data driver 110*c*. In an embodiment, during the offset detection operation, the timing controller 130 generates the offset detection signal to the data driver 110*c* to detect the offset voltages. In another embodiment, the offset voltage detection signal to detect the offset voltages is generated in the offset corrector 121 and transmitted to the data driver 110*c* via the timing controller 130. The offset detection signal transmitted to the data driver 110*c* is transmitted to the D/A converter 112 via the channel logic 111 and converted into analog signals. The analog signals are input to the output circuit 113*c* and the plurality of offset detectors OC1~OCn. The plurality of offset detectors OC1~OCn detects the corresponding offset voltages generated in the coupled output drivers OD1~ODn of the output circuit 113*c* based on the analog signals and display driving signals D01~D0*n* output from the output drivers OD1~ODn which include the offset voltages. The detected offset voltages are stored in the offset memory 122*c*. The offset detection operation will be described in detail later.

When the data driver 110*c* performs the normal operation after the offset detection operation is performed, the data driver 110*c* outputs the display driving signals D01~D0*n* to control the display panel 105 of FIG. 1. During the normal operation, the timing controller 130 generates a corrected image signal Dc, which is obtained by performing offset voltage adjustment in the offset corrector 121, e.g., by subtracting the detected offset voltages from the input image signal Din, and sends the corrected image signal Dc to the data driver 110*c*. The offset voltage adjustment is performed in the offset corrector 121*c* so as to generate the corrected image signal Dc.

During the offset detection operation, the data driver 110*c* receives the offset detection signal and converts the offset detection signal into analog signals using the D/A converter 112 to transmit the analog signals to the plurality of output drivers OD1~ODn in the output circuit 113*c*. On the other hand, during the normal operation, the data driver 110*c* receives the corrected image signal Dc from the timing controller 130 and processes the corrected image signal Dc using the D/A converter 112 and the output circuit 113*c* to output the display driving signals D01~D0*n* corresponding to the corrected image signal Dc.

In particular, in the normal operation, the corrected image signal Dc is input to the channel logic 111 and output as the display driving signals D01~D0*n* through the D/A converter 112 and the output circuit 113*c*. The corrected image signal Dc, which has been obtained by subtracting the offset voltages of the output drivers OD1~ODn from the input image signal Din as described above, is input to the channel logic 111, and then transmitted to the output circuit 113*c* via the D/A converter 112. Each of the output drivers OD1~ODn of the output circuit 113*c* outputs one of the display driving signals D01~D0*n*, which include a signal corresponding to the corrected image signal Dc and an offset voltage of the corresponding output driver. Since the offset voltage has been subtracted in the corrected image signal Dc, an offset voltage generated in the output driver is substantially compensated by the offset voltage adjustment, i.e., the offset voltage subtraction. As a result, the offset voltages less affect the driving signals D01~D0*n* compared to when the input image signal Din is directly transmitted the data driver 110*c* without the offset voltage adjustment.

Before the data driver 110*c* normally operates, for example, during the offset detection operation of the data driver 110, the offset adjusting circuit 120*c* detects the offset voltages generated in the plurality of output drivers OD1~ODn of the data driver 110*c*. Thereafter, during the normal operation, when the data driver 110*c* outputs the display driving signals D01~D0*n* to drive the display panel 105 of FIG. 1, the offset adjusting circuit 120*c* subtracts the offset voltages, generated in the plurality of output drivers OD1~ODn, from the input image signal Din inputted to the timing controller 130 to generate the corrected image signal Dc. Therefore, although offset voltages are generated in the plurality of output drivers OD1~ODn when processing analog signals corresponding to the corrected image signal Dc, since the offset voltages have been subtracted in the corrected image signal Dc, offset voltages included in the display driving signals D01~D0*n* are substantially reduced. That is, the offset voltages less affect the display driving signals D01~D0*n* compared to when the input image signal Din is directly transmitted to the data driver 110*c* without the offset voltage adjustment. Accordingly, the uniformity of an image displayed on the display panel 105 of FIG. 1 can be improved, and thus a sharper image is displayed on the display panel 105.

The plurality of offset detectors OC1~OCn is disposed in the output circuit 113*c* of the data driver 110*c*. The plurality of offset detectors OC1~OCn is configured to be coupled to the output drivers OD1~ODn, respectively, in the output circuit 113*c*. Therefore, when the data driver 110*c* operates before the data driver 110*c* normally operates, for example, during the offset detection operation, the plurality of offset detectors OC1~OCn detects the corresponding offset voltages generated in the coupled output drivers OD1~ODn. The plurality of offset detector OC1~OCn compares analog signals input to the output drivers OD1~ODn with the display driving signal D01~D0*n* output from the output drivers OD1~ODn, thereby detecting the offset voltages generated in the plurality of output drivers OD1~ODn. In an embodiment, the plurality of offset detectors OD1~ODn is not activated during the normal operation. In this embodiment, the plurality of offset detectors OD1~ODn operates at a time after power is supplied to the display device 100 of FIG. 1 and before the input image signal Din is input to the timing controller 130. In some embodiments, the plurality of offset detectors OC1~OCn may detect the offset voltages generated in the output drivers OD1~ODn during the normal operation of the data driver 110*c*.

The D/A converter 112 of the data driver 110*c* receives a first digital signal, e.g., the offset detection signal or the corrected images signal Dc, from the channel logic 111, converts the first digital signal into analog signals, and outputs the analog signals to the output circuit 113*c*. The plurality of output drivers OD1~ODn of the output circuit 113*c* receives the analog signals and buffers the analog signals. Since an offset detector OC1~OCn receives an analog signal from an output driver OD1~ODn and outputs a second digital signal indicative of an offset voltage to the offset memory 122*c*, the offset detector OC1~OCn may include an A/D converter.

The offset memory 122*c* is coupled to the plurality of offset detectors OC1~OCn and configured to receive second digital signals indicative of offset voltages from the offset detectors OC1~OCn and store the offset voltages generated in the plurality of output drivers OD1~ODn. In an embodiment, the offset memory 122*c* is an element physically separate from the timing controller 130 and the offset corrector 121. In another embodiment, the offset memory

122*c* is included in the timing controller 130 or the offset corrector 121. For example, a memory included in the timing controller 130 or the offset correction unit 121 may serve as the offset memory 122*c*. In an embodiment, the offset adjusting circuit 120*c* may further include a multiplexer (not shown) for sequentially receiving the offset voltages from the plurality of offset detectors OC1~OCn. Here, the multiplexer is disposed between the offset memory 122*c* and the plurality of offset detectors OC1~OCn.

The offset corrector 121 is coupled to the timing controller 130 and the offset memory 122*c*. During the normal operation, the offset corrector 121 reads the offset voltages stored in the offset memory 122*c*, receives the input image signal Din from the timing controller 130, and subtracts the read offset voltages from the input image signal Din. Subsequently, the offset corrector 121 sends the subtracted image signal as the corrected image signal Dc to the timing controller 130. In an embodiment, when the data driver 110*c* is initially driven, for example, during the offset detection operation, the timing controller 130 generates and sends the offset detection signal to the data driver 110*c*. During this offset detection operation, the offset corrector 121 may be deactivated.

As a result, the input image signal Din transmitted to the display panel 105 of FIG. 1 is less affected by the offset voltages generated in the plurality of output drivers OD1~ODn of the data driver 110*c*. As a result, the uniformity of an image displayed on the display panel 105 can be improved, and thus a sharper image is displayed on the display panel 105.

Figure 5:
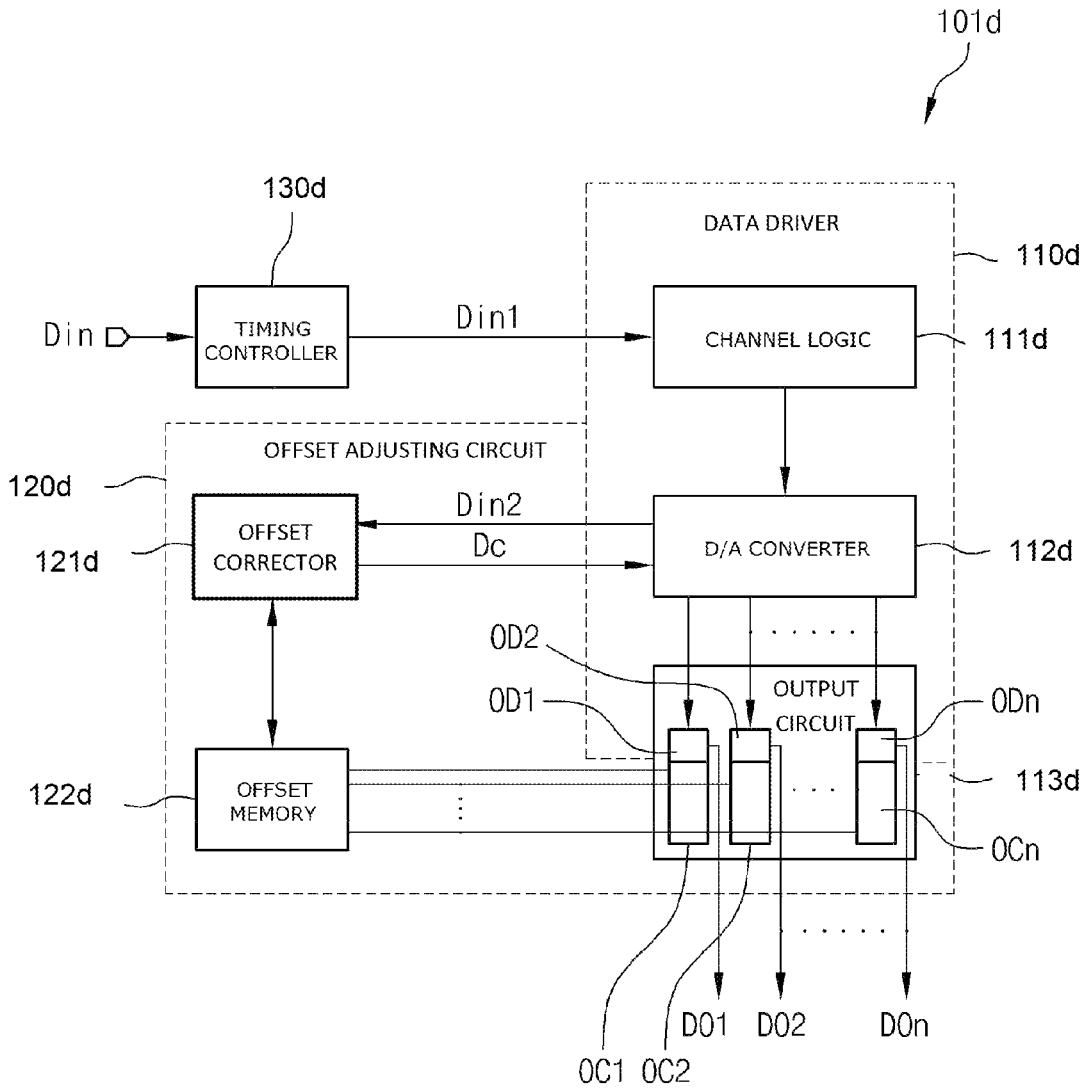
FIG. 5 illustrates a block diagram of a display driving device shown in FIG. 1 in accordance with a fourth embodiment.

FIG. 5 illustrates a block diagram 101*d* of the display driving device 101 of FIG. 1 in accordance with a fourth embodiment. The display driving device 101*d* includes a timing controller 130*d*, a data driver 110*d*, and an offset adjusting circuit 120*d*.

The data driver 110*d* includes a channel logic 111*d*, a D/A converter 112*d*, and an output circuit 113*d*. The offset adjusting circuit 120*d* includes an offset corrector 121*d* and an offset memory 122*d*. The timing controller 130*d*, the channel logic 111*d*, the D/A converter 112*d*, and the offset corrector 121*d* have substantially the same configuration as those of the timing controller 130*b*, the channel logic 111*b*, the D/A converter 112*b*, and the offset corrector 121*b*, respectively, illustrated in FIG. 3. The output circuit 113*d* and the offset memory 122*d* have substantially the same configuration as those of the output circuit 113*c* and the offset memory 122*c*, respectively, illustrated in FIG. 4. Accordingly, the data driver 110*d* includes a plurality of offset detectors OC1~OCn that is coupled to a plurality of output drivers OD1~ODn in the output circuit 113*d*.

When the data driver 110*d* is initially driven (e.g., during an offset detection operation) before a normal operation is performed, the timing controller 130*d* generates and sends an offset detection signal to the data driver 110*d* to detect an offset voltage. In another embodiment, the offset detection signal is generated in the offset corrector 121*d* and directly transmitted to the data driver 110*d* since the offset corrector 121*d* is not coupled to the timing controller 130*d*. Then, the plurality of offset detectors OC1~OCn detects offset voltages of the plurality of output drivers OD1~ODn based on the offset detection signal and stores the detected offset voltages in the offset memory 122*d*, as described with reference to FIG. 4.

The offset corrector 121*d* is coupled to a D/A converter 112*d*. During the normal operation, the offset corrector 121*d* reads the offset voltages stored in the offset memory 122*d*, receives a second image signal Din2 from the D/A converter 112*d*, and subtracts the offset voltages from the second image signal Din2. Subsequently, the offset corrector 121*d* sends the subtracted image signal as a corrected image signal Dc to the D/A converter 112*d*. Then, analog signals output from the D/A converter 112*d*, which correspond to the corrected image signal Dc, are transmitted to the plurality of output drivers OD1~ODn of the output circuit 113*d*.

The plurality of output drivers OD1~ODn buffers the analog signals received from the D/A converter 112*d* and outputs the buffered signals as the display driving signals D01~D0*n*. When an analog signal is processed by an output driver OD1~ODn, the output driver OD1~ODn outputs a display driving signal D01~D0*n*, which includes a signal corresponding to the analog signal and an offset voltage of the output driver OD1~ODn. Since the offset voltage has been subtracted in the corrected image signal Dc, an offset voltage generated in the output driver is substantially compensated by the offset voltage adjustment, i.e., the offset voltage subtraction. As a result, the offset voltages less affect the driving signals D01~D0*n* compared to when the first image signal Din1 is directly transmitted and processed in the data driver 110*d* without the offset voltage adjustment.

As a result, the first image signal Din1 transmitted to the display panel 105 of FIG. 1 is less affected by the offset voltages generated in the output drivers OD1~ODn of the data driver 110*d*. Accordingly, the uniformity of an image displayed on the display panel 105 can be improved, and thus a sharper image is displayed on the display panel 105.

As described above, the display driving device according to an embodiment of the present disclosure processes an input image signal input from an external node, and outputs the processed signal as the display driving signals to display an image on the display panel. In this embodiment, offset voltages generated in the output drivers included in the output stage of the display driving device are substantially compensated by the offset voltage adjustment, and thus the offset voltages less affect the display driving signals, compared to when the input image signal Din is directly processed in the data driver without the offset voltage adjustment. Accordingly, the uniformity of an image displayed on the display panel can be improved, and thus a sharper image is displayed on the display panel.

Furthermore, since an offset adjusting circuit in accordance with an embodiment has a small size, an area occupied by the display driving device may remain substantially the same even though the offset adjusting circuit is employed in the display driving device.

The above-described embodiments have been described for illustrative purposes. It will be apparent to those skilled in the art that various changes, modifications, additions and substitutions are possible, without departing from the spirit and scope of the invention as disclosed in the following claims.

What is claimed is:

1. A display driving device for driving a display panel, the display driving device comprising:

a data driver including a plurality of output drivers, the output drivers configured to output driving signals for driving the display panel;

an offset adjusting circuit configured to receive an input image signal from a timing controller, subtract offset voltages generated in the output drivers from the input image signal to generate a corrected image signal, and transmit the corrected image signal to the timing controller so that the data driver outputs the driving signals based on the corrected image signal; and the timing controller configured to receive the corrected image signal from the offset adjusting circuit and transmit the corrected image signal to the data driver.

2. The display driving device of claim 1, wherein the offset adjusting circuit comprises:

an offset detector coupled to the output drivers and configured to detect the offset voltages of the output drivers; and an offset corrector coupled to the offset detector and the timing controller and configured to subtract the offset voltages from the input image signal.

3. The display driving device of claim 2, wherein the offset adjusting circuit further includes an offset memory configured to store the offset voltages detected by the offset detector and transmit the stored offset voltages to the offset corrector.

4. The display driving device of claim 2, wherein the offset adjusting circuit further includes a multiplexer configured to select one of the driving signals to transmit the selected driving signal to the offset detector.

5. The display driving device of claim 2, wherein the timing controller is further configured to receive the input image signal from an external node and transmit the received input image signal to the offset corrector, and wherein the offset corrector is configured to subtract the offset voltages detected by the offset detector from the input image signal to generate the corrected image signal, and to transmit the corrected image signal to the timing controller.

6. The display driving device of claim 2, wherein the data driver further includes a digital-to-analog (D/A) converter configured to convert the corrected image signal into a plurality of analog signals, and wherein the output drivers buffer the analog signals and output the buffered signals as the driving signals, respectively.

7. The display driving device of claim 1, wherein the offset adjusting circuit includes:

a plurality of offset detectors coupled to the output drivers, respectively, the offset detectors each configured to detect an offset voltage of a corresponding one of the output drivers; and an offset corrector configured to subtract the detected offset voltages from the input image signal and generate the corrected image signal.

8. The display driving device of claim 7, wherein the data driver further includes a D/A converter configured to convert the corrected image signal into a plurality of analog signals, wherein the output drivers buffer the analog signals to output the buffered signals as the driving signals, respectively.

9. A method comprising:

detecting offset voltages of a plurality of output drivers of a data driver;

receiving an input image signal from a timing controller;

subtracting the offset voltages of the output drivers from the input image signal to generate a corrected image signal;

transmitting the corrected image signal through the timing controller to the data driver; and outputting data driving signals through the output drivers.

10. The method of claim 9, wherein detecting the offset voltages comprises:

transmitting an offset detection signal to detect the offset voltages to the data driver;

converting the offset detection signal into a plurality of analog signals;

outputting data driving signals corresponding to the offset detection signal based on the analog signals; and comparing each of the analog signals with a corresponding one of the data driving signals corresponding to the offset detection signal to detect the offset voltages of the output drivers.

11. The method of claim 9, wherein outputting the data driving signals comprises:

converting the corrected image signal into a plurality of analog signals; and buffering the analog signals and outputting the buffered analog signals as the data driving signals.

12. The display driving device of claim 1, wherein the timing controller is a distinct element from the offset adjusting circuit.

13. A display driving device for driving a display panel, the display driving device comprising:

a data driver including a plurality of output drivers, the output drivers configured to output driving signals for driving the display panel;

an offset adjusting circuit configured to subtract offset voltages generated in the output drivers from an input image signal to generate a corrected image signal, the offset adjusting circuit comprising:

an offset detector coupled to the output drivers and configured to detect the offset voltages of the output drivers; and an offset corrector coupled to the offset detector and the timing controller and configured to subtract the offset voltages from the input image signal to generate the corrected image signal; and a timing controller configured to receive the input image signal from an external node and transmit the input image signal to the offset corrector, the timing controller configured to further receive the corrected image signal from the offset corrector and transmit the corrected image signal to the data driver so that the data driver outputs the driving signals based on the corrected image signal.

* * * * *